US011828292B1

(12) United States Patent
Evans et al.

(10) Patent No.: US 11,828,292 B1
(45) Date of Patent: Nov. 28, 2023

(54) FAN WITH INCREASED EFFICIENCY MODE

(71) Applicant: DELTA T, LLC, Lexington, KY (US)

(72) Inventors: Eric Evans, Lexington, KY (US); Andrew Koukis, Lexington, KY (US); Pete Maley, Lexington, KY (US); Christian Taber, Minneapolis, MN (US)

(73) Assignee: DELTA T, LLC, Lexington, KY (US)

( * ) Notice: Subject to any disclaimer, the term of this patent is extended or adjusted under 35 U.S.C. 154(b) by 27 days.

(21) Appl. No.: 17/333,714

(22) Filed: May 28, 2021

Related U.S. Application Data

(60) Provisional application No. 63/031,981, filed on May 29, 2020.

(51) Int. Cl.

| | |
|---|---|
| ***F04D 27/00*** | (2006.01) |
| ***F04D 25/08*** | (2006.01) |
| *F24F 11/46* | (2018.01) |
| *F24F 11/77* | (2018.01) |

(52) U.S. Cl.
CPC ..... *F04D 27/004* (2013.01); *F04D 25/088* (2013.01); *F24F 11/46* (2018.01); *F24F 11/77* (2018.01)

(58) Field of Classification Search
CPC ..... F04D 27/004; F04D 25/088; F24F 11/77
See application file for complete search history.

(56) References Cited

U.S. PATENT DOCUMENTS

| | | | | |
|---|---|---|---|---|
| 9,551,356 | B2 * | 1/2017 | Leesman | F04D 29/526 |
| 2017/0016646 | A1 * | 1/2017 | Lee | F24F 11/46 |
| 2017/0343240 | A1 * | 11/2017 | Yu | F04D 33/00 |

* cited by examiner

*Primary Examiner* — Michael L Sehn
(74) *Attorney, Agent, or Firm* — Dickinson Wright PLLC; Andrew D. Dorisio

(57) ABSTRACT

An apparatus includes a fan and a controller configured for controlling the fan to operate in a first mode limiting rotational speed of the fan within a first range of speeds between a first minimum speed and a first maximum speed. The controller is further configured to control the fan to operate in a second mode limiting rotational speed of the fan within a second range of speeds between a second minimum speed and a second maximum speed. The second range of speeds may be narrower than the first range of speeds. Related methods are also disclosed.

15 Claims, 1 Drawing Sheet

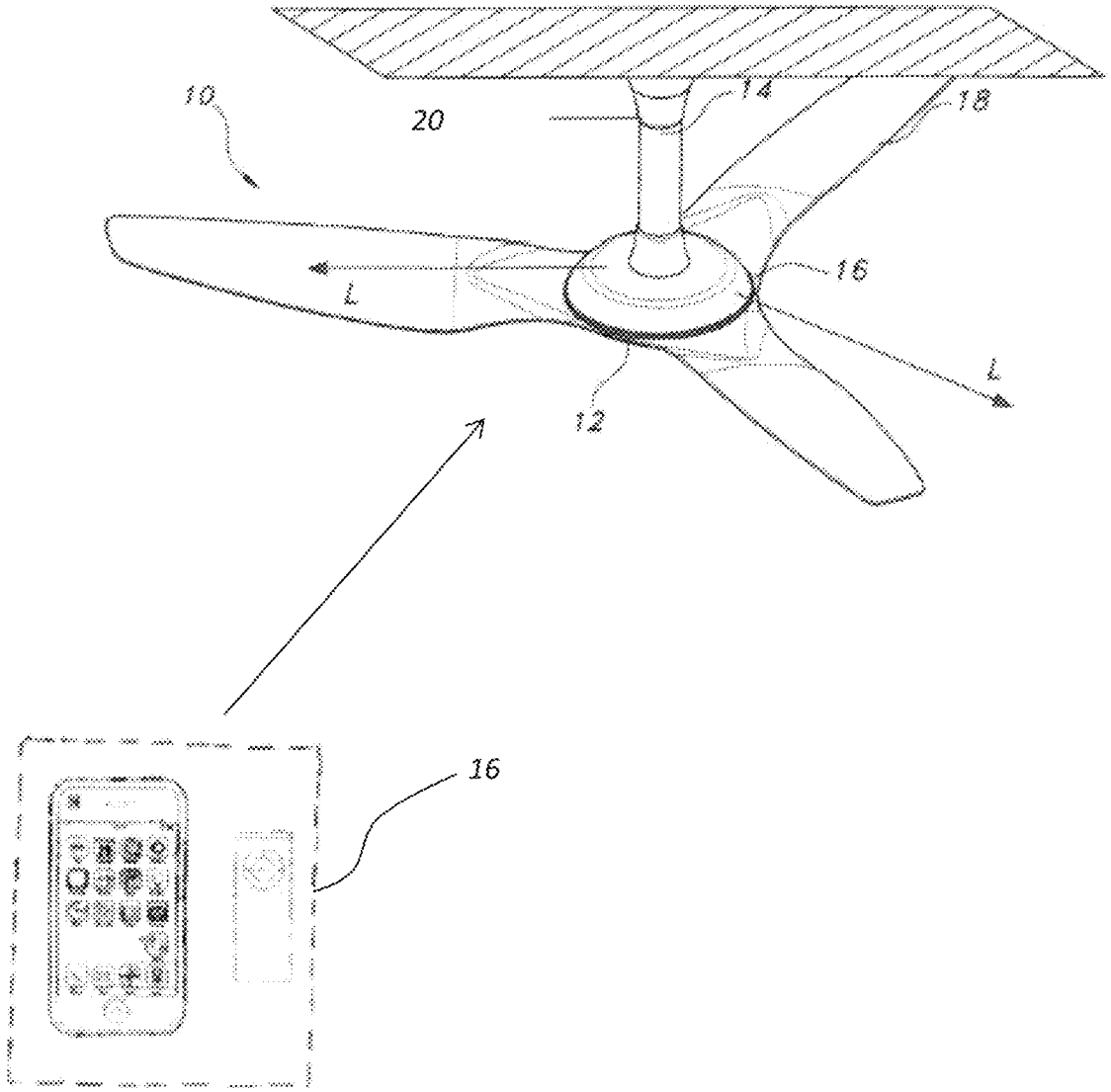
10
20
14
18
16
L
L
12
16

FAN WITH INCREASED EFFICIENCY MODE

This patent application claims the benefit of U.S. Provisional Patent Application Ser. No. 63/031,981, the disclosure of which is incorporated herein by reference.

TECHNICAL FIELD

This application relates generally to the air handling arts and, more particularly, to a fan having a normal mode of operation and a high efficiency mode of operation.

BACKGROUND OF THE INVENTION

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pat. Pub. No. 2008/0008596, entitled "Fan Blades," published Jan. 10, 2008; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are also incorporated by reference herein. It should be understood that teachings herein may be incorporated into any of the fans described in any of the above-referenced patents, publications, or patent applications. It should also be understood that a fan may include sensors or other features that are used to control, at least in part, operation of a fan system. For instance, such fan systems are disclosed in U.S. Pat. Pub. No. 2009/0097975, entitled "Ceiling Fan with Concentric Stationary Tube and Power-Down Features," published Apr. 16, 2009, the disclosure of which is incorporated by reference herein; U.S. Pat. Pub. No. 2009/0162197, entitled "Automatic Control System and Method to Minimize Oscillation in Ceiling Fans," published Jun. 25, 2009, the disclosure of which is incorporated by reference herein; U.S. Pat. Pub. No. 2010/0291858, entitled "Automatic Control System for Ceiling Fan Based on Temperature Differentials," published Nov. 18, 2010, the disclosure of which is incorporated by reference herein; and U.S. Provisional Patent App. No. 611165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

Consumers often desire energy efficient products, both from an ecological standpoint and a financial standpoint. Fans, such as ceiling fans, are one such product that are present in many homes and places of business, and therefore energy efficiency statistics for fans are important, including from a marketability standpoint, across a wide market.

When advertising statistics regarding energy efficiency or energy use of ceiling fans, uniform comparisons across a given market allows an end user to compare more accurately one ceiling fan to another. For example, the U.S. Department of Energy (DOE) has promulgated certain regulations wherein any manufacturer making any representations with respect to the energy use or efficiency of ceiling fans must do so according to particular testing requirements and calculations, as outlined in 10 C.F.R. 429 and 430, the disclosures of which are fully incorporated herein by reference. Other jurisdictions include similar harmonized standards for energy efficiency with respect to fans.

In certain jurisdictions, such as the United States, documentation is available to the public regarding fans whose manufacturers make a claim regarding energy use or energy efficiency, so that the public may compare and contrast the energy usage of various fans. This may be a regulation instituted by a government body, such as the Federal Trade Commission in the United States. For example, products that have achieved certification according to ENERGY STAR certification standards in the U.S., including ceiling fans, may be accessed at the website http://www.energystar.gov, the disclosure of which is incorporated herein by reference. Accordingly, a user may search and compare the standard energy efficiency data regarding all ceiling fans which have achieved the Energy Star rating.

In some instances, this desire for energy efficiency may be tempered with or accompany a desire for more expansive user control and/or power output from a fan. For example, under normal use, a user may desire high or maximized energy efficiency, but that same user may still prefer the ability to have an increased (or decreased) air speed at the occupant level, volumetric flow rate, fan speed, or energy consumption from the fan, particularly in the presence of more extreme environmental conditions. Alternatively, a user may normally want a high degree of variability in control of air speed at the occupant level, volumetric flow rate, fan speed and/or power consumption, but at times may desire an operating mode using less energy.

Accordingly, a need is identified for a fan that allows for a normal mode of operation that allows for greater energy consumption, and an energy efficient mode of operation that limits energy consumption compared to the normal mode, taking into account at least the above considerations.

SUMMARY

According to a first aspect of the disclosure, an apparatus comprises a fan and a controller configured for controlling the fan to operate in a first mode. The first mode limits a rotational speed of the fan within a first range of speeds between a first minimum speed and a first maximum speed. The controller is further configured for controlling the fan to operate in a second mode. The second mode limits the rotational speed of the fan within a second range of speeds between a second minimum speed and a second maximum speed. The second range of speeds is narrower than the first range of speeds.

In one embodiment, the first range of speeds includes at least one preset speed between the first minimum speed and the first maximum speed. The first range of speeds may include a plurality of preset speeds between the first minimum speed and the first maximum speed. The second range of speeds may include at least one preset speed between the second minimum speed and the second maximum speed. The second range of speeds may include a plurality of preset speeds between the second minimum speed and the second maximum speed.

The fan may operate at a first efficiency in the first mode, and operate at a second efficiency in the second mode. The second efficiency may be greater than the first efficiency. The first efficiency and the second efficiency are calculated as a ratio of total airflow induced by the fan over a given time period to total power consumption by the fan over the given time period. The given time period may be, for example, 24 hours, and during the 24 hours the fan may be operated at the maximum speed for 3.4 hours, at the minimum speed for 3.0 hours, and in a standby mode for 17.6 hours.

The second efficiency may be calculated based at least partially on an extrapolation of volumetric flow rate and an extrapolation of power consumption of the fan at the second minimum speed and the second maximum speed. The extrapolation of volumetric flow rate may be based on a regression of volumetric flow rate versus speed of the fan in the first mode. The regression of volumetric flow rate may be a linear regression. The extrapolation of power consumption may be based on a regression of power consumption versus speed of the fan in the first mode. The regression of power consumption may be a polynomial regression.

In one example, the first minimum speed and the second minimum speed are between 50 and 100 rpm. The first maximum speed and the second maximum speed may be between 100 and 200 rpm.

According to a second aspect of the disclosure, a method of operating a fan comprises operating the fan in a first mode, the first mode limited to a first range of speeds between a first minimum speed and a first maximum speed. The method further includes operating the fan in a second mode, the second mode limited to a second range of speeds between a second minimum speed and a second maximum speed. The second range of speeds may be narrower than the first range of speeds.

The first mode includes a plurality of first preset speeds including the first minimum speed, the first maximum speed, and at least one first intermediate speed. The at least one first intermediate speed includes a plurality of intermediate speeds. The method may further comprise the step of calculating a first efficiency of the fan in the first mode, as well as measuring fan speed, volumetric air flow rate, and power consumption of the fan in the first mode.

The step of calculating the first efficiency may comprise dividing a total air flow of the fan in the first mode over a first time period by a total power consumption of the fan in the first mode over the first time period. The method may further comprise the step of extrapolating a first mathematical relationship between fan speed and volumetric air flow rate of the fan in the first mode. The step of extrapolating a second mathematical relationship between fan speed and power consumption of the fan in the first mode.

Still further, the method may comprise the steps of estimating a minimum volumetric air flow rate at the second minimal speed and a maximum volumetric air flow rate at the second maximum speed of the fan in the second mode based on the first mathematical relationship. The method may further comprise estimating a minimum power consumption at the second minimal speed and a maximum volumetric air flow rate at the second maximum speed of the fan in the second mode based on the second mathematical relationship.

The method may also include the step of calculating a second efficiency of the fan in the second mode, which may comprise dividing a total air flow of the fan in the second mode at the second minimal speed and the second maximum speed over a second time period by a total power consumption of the fan in the second mode at the second minimum speed and the second maximum speed over the second time period. The first time period is equal to the second time period.

The method may further the step of selecting the second minimum speed and the second maximum speed such that the second efficiency is higher than the first efficiency. The method may also comprise the step of selecting the second minimum speed and the second maximum speed such that the second efficiency is higher than a threshold value. The threshold value may be a maximum listed efficiency of any fan in a database of fan efficiencies.

A further aspect of the disclosure relates to a method of operating a fan. The method comprises operating the fan in a first mode at a first efficiency. The method further comprises operating the fan in a second mode at a second efficiency, different from the first efficiency.

Yet another aspect of the disclosure pertains to a method of operating a fan. The method comprises operating the fan in a first mode at a plurality of first speeds inclusively between a first minimum speed and a first maximum speed. The method further comprises calculating a first efficiency of the fan in the first mode. The first efficiency may be based at least partially on dividing a total airflow of the fan operated at both the first minimum speed and the first maximum speed over a first time period by a total power consumption of the fan operated at both the first minimum speed and the first maximum speed over the first time period. The method may further include selecting a second minimum speed and a second maximum speed, such that a primary consideration is achieved. The primary consideration may be that a second efficiency is greater than the first efficiency, the second efficiency based at least partially on dividing a total airflow of the fan operated at both the second minimum speed and the second maximum speed over the first time period by a total power consumption of the fan operated at both the second minimum speed and the second maximum speed over the first time period. The fan may then be operated in a second mode at a plurality of second speeds inclusively between the second minimum speed and the second maximum speed.

In one embodiment, the method may further include the steps of measuring a plurality of first volumetric air flow rates corresponding to each of the plurality of first speeds and extrapolating a first mathematical relationship between volumetric air flow rate and fan speed in the first mode, and measuring a plurality of first values of power consumption corresponding to each of the plurality of first speeds and extrapolating a second mathematical relationship between power consumption and fan speed in the first mode. The total airflow of the fan operated at both the second minimum speed and the second maximum speed may be calculated based on the first mathematical relationship. The total power consumption of the fan operated at both the second minimum speed and the second maximum speed may be based on the second mathematical relationship. The selecting step may comprise selecting the second minimum speed and/or the second maximum based on one or more of the following secondary considerations: (a) the second efficiency is greater than a highest efficiency of any other fan in a classification which is the same as the classification of the fan being operated in the second mode; (b) the second maximum speed does not exceed a highest maximum speed allowed for the classification; and (c) a second span of speeds between the second minimum speed and the second maximum speed is maximized within constraints established by the primary consideration and/or secondary considerations (a) or (b).

BRIEF DESCRIPTION OF THE DRAWING FIGURES

The sole figure is a schematic representation of a fan with a control for implementing an energy efficient mode.

DETAILED DESCRIPTION

Referring to the figure, an exemplary fan 10 according to one embodiment comprises a hub 12, which may include a motor (which may be enclosed or contained within or adjacent to hub 12). The fan 10 may be connected to a support 14, and may also include a plurality of fan blades 18. In the present example, fan 10 (including hub 12 and fan blades 18) has a diameter of approximately 2-8 feet. In other variations, fan 10 has a diameter of up to 24 feet. Alternatively, fan 10 may have any other suitable dimensions depending on a particular application.

Support 14 is configured to be coupled to a surface (such as a ceiling) or other stable support structure (such as a joist, beam, or the like) at a first end such that fan 10 is substantially attached to the surface or other structure. Support 14 of the present example comprises an elongate metal tube-like structure that couples the fan 10 to a ceiling, though it should be understood that support 14 may be constructed and/or configured in a variety of other suitable ways as will be apparent to one of ordinary skill in the art in view of the teachings herein.

By way of example only, support 14 need not be coupled to a ceiling or other overhead structure, and instead may be coupled to a wall or to the ground. For instance, support 14 may be positioned on the top of a post that extends upwardly from the ground. Alternatively, support 14 may be mounted in any other suitable fashion at any other suitable location. By way of example only, support 14 may be configured in accordance with the teachings of U.S. Pat. Pub. No. 2009/0072108, entitled "Ceiling Fan with Angled Mounting," published Mar. 19, 2009, the disclosure of which is incorporated by reference herein. As yet another alternative, support 14 may have any other suitable configuration for a fan such as the one depicted, and variations will be apparent to those of ordinary skill in the art in view of the teachings herein.

The motor may comprise an AC induction motor having a drive shaft, though it should be understood that motor may alternatively comprise any other suitable type of motor (e.g., a permanent magnet brushless DC motor, a brushed motor, an inside-out motor, etc.). In the present example, motor is fixedly coupled to support 14 and rotatably coupled to hub 12. Furthermore, motor is operable to rotate hub 12 and the plurality of fan blades 18. By way of example only, motor may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan 10 may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, motor may have any other suitable components, configurations, functionalities, and operability, as will be apparent to those of ordinary skill in the art in view of the teachings herein.

Hub 12 may be constructed in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, hub 12 may be constructed in accordance with any of the teachings or other patent references cited herein. Still other suitable ways in which hub 12 may be constructed will be apparent to those of ordinary skill in the art in view of the teachings herein. It should also be understood that an interface component (not shown) may be provided at the interface of each fan blade 18 and hub 12. By way of example only, such an interface component may be configured in accordance with the teachings of U.S. Pat. Pub. No. 2009/0081045, entitled "Aerodynamic Interface Component for Fan Blade," published Mar. 26, 2009, the disclosure of which is incorporated by reference herein. Of course, such an interface component may be omitted if desired.

Fan blades 18 may further be constructed in accordance with some or all of the teachings of any of the patents, patent publications, or patent applications cited herein. For example, fan blades 18 may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades 18 may be configured in accordance with the teachings of U.S. Pat. Pub. No. 2008/0008596, entitled "Fan Blades," published Jan. 10, 2008, the disclosure of which is also incorporated by reference herein. As yet another merely illustrative example, fan blades 18 may be configured in accordance with the teachings of U.S. Pat. Pub. No. 2010/0104461, entitled "Multi-Part Modular Airfoil Section and Method of Attachment Between Parts," published Apr. 29, 2010, the disclosure of which is incorporated by reference herein. Alternatively, any other suitable configurations for fan blades 18 may be used in conjunction with the examples described herein. For example, fan blades 18 may be formed of aluminum through an extrusion process such that each fan blade has a substantially uniform cross section along its length. It should be understood that fan blades 18 may alternatively be formed using any suitable material, or combination of materials, by using any suitable technique, or combination of techniques, and may have any suitable cross-sectional properties or other properties as will be apparent to one of ordinary skill in the art in view of the teachings herein.

In the context of energy efficiency evaluations, ceiling fans, such as the fan 10 depicted in the figure, may be divided into different categories based on physical and operational characteristics. For example, fans may be divided between "small-diameter ceiling fans" (i.e. fans with a diameter equal to or less than seven feet) and "large diameter ceiling fans (i.e. fans with a diameter greater than seven feet). In addition, fans may be divided based on whether they are high-speed or low-speed ceiling fans, based at least partially on whether their maximum blade tip speed is greater than a threshold value or not. As a non-limiting example, the U.S. DOE defines a high-speed small-diameter ceiling fan as a fan having a blade thickness of less than 3.2 mm at the edge or a maximum tip speed greater than the applicable limit specified in the following Table 1:

TABLE 1

HIGH-SPEED SMALL-DIAMETER CEILING FAN BLADE AND TIP SPEED CRITERIA

| | Thickness (t) of edges of blades | | Tip speed threshold | |
|---|---|---|---|---|
| Airflow direction | Mm | inch | m/s | feet per minute |
| Downward-only | 4.8 > t ≥ 3.2 | 3/16 > t ≥ 1/8 | 16.3 | 3,200 |
| Downward-only | t ≥ 4.8 | t ≥ 3/16 | 20.3 | 4,000 |
| Reversible | 4.8 > t ≥ 3.2 | 3/16 > t ≥ 1/8 | 12.2 | 2,400 |
| Reversible | t ≥ 4.8 | t ≥ 3/16 | 16.3 | 3,200 |

Additionally, the U.S. DOE defines low-speed small-diameter ceiling fan as a fan having a blade thickness greater than or equal to 3.2 mm at the edge and a maximum tip speed less than or equal to the applicable limit specified in the following Table 2:

TABLE 2

LOW-SPEED SMALL-DIAMETER CEILING FAN BLADE AND TIP SPEED CRITERIA

| | Thickness (t) of edges of blades | | Tip speed threshold | |
|---|---|---|---|---|
| Airflow direction | Mm | inch | m/s | feet per minute |
| Reversible | 4.8 > t ≥ 3.2 | 3/16 > t ≥ 1/8 | 12.2 | 2,400 |
| Reversible | t ≥ 4.8 | t ≥ 3/16 | 16.3 | 3,200 |

Similarly, Underwriters Laboratories (UL) has created certain operational safety standards for ceiling fans. These standards may be found in UL 507 Standard of Safety, Electric Fans. These standards define, among other things, maximum speed at the blade tip for ceiling fans of different blade thicknesses, which are mounted between 7 and 10 feet above the floor. Accordingly, a user or manufacturer may wish to maintain ceiling fan blade tip speed within such parameters during operation.

The fan 10 may include a controller 20 to control the fan, such as by activating it, deactivating it, reversing its direction, regulating fan speed, or regulating mode of operation of the fan. In one aspect of the disclosure, a user input 16 is provided for allowing a user to control the fan 10, such as through the input of a fan speed or selection of one or more modes of operation (e.g. a normal mode of operation and an energy efficient mode of operation that is more energy efficient than the normal mode of operation). The input 16 may comprise a wired or wireless remote control. As one example, the input 16 may be provided by way of a remote control in the form of a user specific input device, such as a "smart" phone, computer, or the like, running associated software for communicating the desired value to the fan controller 20 in recognizable form. The input 16 may also take the form of a building automation system.

In a normal mode of operation, also referred to as a first mode of operation, the controller 20 may cause the fan to be adapted to run at a plurality of blade speeds, such as between a first minimum speed and a first maximum speed. The first minimum speed may be the minimum speed (above zero) at which the fan is adapted to rotate in the normal mode. The first maximum speed may be the maximum speed at which the fan is adapted to rotate in the normal mode. The first minimum speed and the first maximum speed may be preset limits of operation in the first mode.

In one aspect, the first mode may include one or more additional preset speeds between the first minimum speed and the first maximum speed. For example, the first mode of operation may be adapted to operate the fan at three, five, seven, or more preset speeds, inclusive of the first minimum speed and the first maximum speed.

The fan 10 may operate at an efficiency rating in the first mode. The efficiency means the ratio of total air flow to total power consumption over a given time period. The units for efficiency may be cubic feet per minute per watt (CFM/W).

In one example of efficiency measurement and calculation, the U.S. DOE has outlined certain efficiency standards in 10 C.F.R. 430 (Appendix U to Subpart B of Part 430), the entirety of which is incorporated herein by reference. These efficiency measurements may be standardized for a given type of fan, such as according to the manner in which a typical fan of a given type would be used under normal conditions, for a given period of time. Under these standards, the efficiency a low-speed small-diameter (LSSD) ceiling fan is calculated based on running at a high speed for 3.4 hours, at a low speed for 3.0 hours, and in and "off" or "standby" mode for 17.6 hours (for a total of 24 hours). The total air flow and the total power consumption of a given fan may be measured under these conditions, and an efficiency of the fan may be calculated. By using standard conditions for a given fan type, the efficiency of all fan models of a given type may be standardized across an industry.

Calculation of a fan's efficiency, as outlined by the U.S. DOE, may be accomplished according to the following equation:

$$\text{Ceiling Fan Efficiency}\left(\frac{CFM}{W}\right) = \frac{\sum_i (CFM_i \times OH_i)}{W_{sb} \times OH_{sb} + \sum_i (W_i \times OH_i)}$$

Where:

$CFM_i$=airflow at speed i, $OH_i$=operating hours at speed i, $W_{sb}$=power consumption in standby mode, $OH_{sb}$=operating hours in standby mode, and $W_i$=power consumption at speed i.

Therefore, according to the standard operating parameters during efficiency testing under U.S. DOE guidelines, the efficiency of a ceiling fan relates to air flow and power consumption at maximum speed, at minimum speed, and in standby mode.

In one aspect, a ceiling fan efficiency may be calculated for a given fan model according to the above DOE standards in the first mode, or normal mode. The controller 20 may be further adapted to cause the fan to be adapted to operate in a second mode, with a second maximum speed and a second minimum speed, which results in a different efficiency of the second mode. This second mode may be an energy efficient mode. The second maximum speed and the second minimum speed may be selected such that the DOE ceiling fan efficiency calculation results in a higher efficiency in the second mode than in the first mode.

Various additional factors may influence the selection of the second maximum speed and the second minimum speed. A first additional factor may be a desired efficiency in the second mode that exceeds a threshold value. For example, the second maximum speed and the second minimum speed may be selected such that the ceiling fan efficiency in the second mode exceeds the highest reported ceiling fan efficiency of any fan in a given database (e.g. all ceiling fans of a given type or class in a database of ENERGY STAR certified ceiling fans available in a given market). In one instance, the ceiling fan efficiency in the second mode may be higher than any ceiling fan efficiency of any fan in the same classification as the subject ceiling fan.

A second factor that may influence the selection of the second maximum speed and the second minimum speed may be the goal of maximizing user functionality. In practice, the second maximum speed and the second minimum speed may define a second range of speeds that is narrower than a first range of speeds defined by the first maximum speed and the first minimum speed of the fan in the first mode. While this second range of speeds may be narrower than the first range of speeds, the selection of the second maximum speed and the second minimum speed may be such that the second range of speeds is as wide as possible or feasible, while still considering other relevant factors.

A third factor that may influence the selection of the second maximum speed and the second minimum speed may be the goal of having the subject ceiling fan be classified according to a particular fan type or classification. For example, as noted above, the DOE imposes particular maximum speed limits in order for a fan to be classified as a low-speed small-diameter ceiling fan. Accordingly, the second maximum speed may be selected such that it does not exceed the maximum speed limit in order for the subject ceiling fan to be classified as a low-speed small-diameter ceiling fan.

Any combination of these factors may be utilized in selecting the second maximum speed and the second minimum speed of the second mode of the ceiling fan.

Selection of the second maximum speed and second minimum speed will be discussed with respect to the various examples below.

Example 1:

In a first example, a first fan model is a 52-inch diameter fan adapted for rotating at a plurality of preset speeds across a first speed range in the first mode. In this instance, the plurality of preset speeds comprises 7 preset speeds. Steady-state speed (RPM), power consumption (W), and air flow rate (CFM) may be measured across the first speed range, as indicated in Table 3. A measure of the steady state air flow rate per watt may also be calculated at each of the preset speeds.

TABLE 3

Performance Data of First Mode of First Fan Model

| Speed | RPM | Power | CFM | CFM/W |
|---|---|---|---|---|
| 1 | 48.7 | 2.2 | 1402 | 637 |
| 2 | 79.0 | 3.4 | 2430 | 715 |
| 3 | 94.0 | 4.2 | 2913 | 694 |
| 4 | 140.0 | 8.4 | 4438 | 528 |
| 5 | 164.6 | 12.2 | 5209 | 427 |
| 6 | 177.5 | 14.5 | 5624 | 388 |
| 7 | 199.7 | 19.9 | 6240 | 314 |

In accordance with DOE standards, the efficiency testing data of the first fan model in the first mode, including a measured standby mode power consumption of 1.3 W, are presented in Table 4.

TABLE 4

DOE Efficiency Data of First Mode of First Fan Model

| LSSD | Hours | Watts | CFM | CFM/W |
|---|---|---|---|---|
| Maximum Speed | 3.4 | 19.9 | 6,240 | 314 |
| Minimum Speed | 3 | 2.2 | 1,402 | 637 |
| Standby | 17.6 | 1.3 | — | |

Using these numbers, the ceiling fan efficiency (DOE Efficiency) of the first fan model in the first mode may be calculated according to the above DOE equation. In addition, various other data points, including average airflow during operation, average power, and average energy cost (based on an estimated $0.12/kWh, in accordance with DOE guidance), as indicated in Table 5.

TABLE 5

DOE Efficiency - First Mode of First Fan Model

| | | |
|---|---|---|
| Efficiency | 262 | CFM/W |
| Average Airflow | 3972 | CFM |
| Average Power | 15 | W |
| Annual Energy Cost | $4 | |

In order to improve the efficiency of the ceiling fan in the second mode, a more complete evaluation of performance data of the first fan model across a range of speeds may be estimated, so that a plurality of possible DOE Efficiency calculations may be made for comparison purposes. Rather than incrementally set the ceiling fan to every speed to be evaluated, the measured performance data of the fan at the preset speeds may be used to estimate performance data at any speed across the first speed range, such as by regression analysis.

In one aspect, using the preset speeds of the first mode, a first mathematical relationship may be estimated between the fan speed and the volumetric air flow rate across all capable fan speeds of the first fan model. Fan affinity laws indicate that fan speed and volumetric air flow rate are related in a linear fashion, and therefore the first mathematical relation may be linear. Accordingly, the first mathematical relationship may be estimated by a linear regression of the measured performance data of the first fan model. Once the first mathematical relationship has been estimated, the value for a given volumetric air flow rate at a given fan speed may be interpolated as needed. In this example, based on the measured performance data of the first fan model of Table 3, the first mathematical relationship may be characterized according to the following equation:

$$VAFR_1=(32.259\times FS_1)-127.61$$

Where:

$VAFR_1$=volumetric air flow rate of the first fan model (CFM), and $FS_1$=fan speed of the first fan model (RPM).

In another aspect, using the preset speeds of the first mode, a second mathematical relationship may be estimated between the fan speed and the power consumption across all capable fan speeds of the first fan model. Fan affinity laws indicate that fan speed and power consumption are related in a non-linear fashion, and therefore the second mathematical relation may be represented by a polynomial equation. Accordingly, the second mathematical relationship may be estimated by a non-linear (e.g., polynomial) regression of the measured performance data of the first fan model. Once the second mathematical relationship has been estimated, the value for a given power consumption at a given fan speed may be interpolated as needed. In this example, based on the measured performance data of the first fan model of Table 3, the second mathematical relationship may be characterized according to the following equation:

$$PC_1=2.974\times10^{-6}\times FS_1^3-3.31\times10^{-4}\times FS_1^2+4.457\times10^{-2}\times FS_1+0.484$$

Where:

$PC_1$=power consumption of the first fan model (W), and $FS_1$=fan speed of the first fan model (RPM).

Based on these mathematical relationships, the volumetric air flow rate (CFM) and power consumption (Power) associated with fan function can be estimated across a wide range of low speeds (e.g., less than 100 RPM) and high speeds (e.g., greater than 100 RPM). In the example of the first fan model, these estimated performance characteristics are listed in Table 6. Table 6 also includes the power consumption of the first fan model in standby mode (i.e., 1.3 W) for comparison.

TABLE 6

Estimated Performance Characteristics at Low Speed and High Speed Ranges of First Fan Model

| Low RPM | CFM | Power | High RPM | CFM | Power | Standby |
|---|---|---|---|---|---|---|
| 50 | 1485 | 2.3 | 100 | 3098 | 4.6 | 1.3 |
| 55 | 1647 | 2.4 | 110 | 3421 | 5.3 | |
| 60 | 1808 | 2.6 | 120 | 3743 | 6.2 | |
| 65 | 1969 | 2.8 | 130 | 4066 | 7.2 | |
| 70 | 2131 | 3.0 | 140 | 4389 | 8.4 | |
| 75 | 2292 | 3.2 | 150 | 4711 | 9.8 | |
| 80 | 2453 | 3.5 | 160 | 5034 | 11.3 | |
| 85 | 2614 | 3.7 | 170 | 5356 | 13.1 | |
| 90 | 2776 | 4.0 | 180 | 5679 | 15.1 | |
| 95 | 2937 | 4.3 | 190 | 6002 | 17.4 | |
| 100 | 3098 | 4.6 | 200 | 6324 | 20.0 | |

By using this list of estimated performance characteristics of the ceiling fan, a matrix may be created of various calculated ceiling fan efficiency ratings (according to the DOE equation) based on various combinations of maximum speeds and minimum speeds.

TABLE 7

Estimated Efficiency Ratings of First Fan Model at Various Combinations of Second Maximum Speed and Second Minimum Speed

| Low RPM | High RPM 100 | 110 | 120 | 130 | 140 | 150 | 160 | 170 | 180 | 190 |
|---|---|---|---|---|---|---|---|---|---|---|
| 50 | 330.9 | 336.5 | 338.6 | 337.3 | 332.9 | 325.9 | 316.5 | 305.4 | 293.1 | 279.9 |
| 55 | 337.7 | 342.9 | 344.6 | 343.0 | 338.3 | 330.8 | 321.2 | 309.8 | 297.2 | 283.7 |
| 60 | 344.2 | 349.0 | 350.4 | 348.4 | 343.3 | 335.6 | 325.7 | 314.0 | 301.1 | 287.4 |
| 65 | 350.3 | 354.8 | 355.8 | 353.5 | 348.2 | 340.1 | 329.9 | 318.0 | 304.9 | 290.9 |
| 70 | 356.0 | 360.1 | 360.9 | 358.3 | 352.7 | 344.4 | 334.0 | 321.8 | 308.5 | 294.3 |
| 75 | 361.2 | 365.1 | 365.5 | 362.6 | 356.8 | 348.3 | 337.7 | 325.4 | 311.8 | 297.5 |
| 80 | 365.9 | 369.5 | 369.7 | 366.6 | 360.6 | 351.9 | 341.1 | 328.7 | 315.0 | 300.5 |
| 85 | 370.1 | 373.4 | 373.3 | 370.1 | 363.9 | 355.2 | 344.2 | 331.6 | 317.8 | 303.2 |
| 90 | 373.6 | 376.7 | 376.5 | 373.1 | 366.8 | 358.0 | 347.0 | 334.3 | 320.4 | 305.7 |
| 95 | 376.5 | 379.4 | 379.1 | 375.6 | 369.2 | 360.3 | 349.3 | 336.6 | 322.6 | 307.9 |
| 100 | 378.8 | 381.5 | 381.1 | 377.5 | 371.2 | 362.3 | 351.2 | 338.5 | 324.6 | 309.8 |
| Maximum DOE Eff | | | | 381.5 | | | | | | |

When selecting the second maximum speed and the second minimum speed for the second mode, the first consideration is that the resulting efficiency is greater than the efficiency in the first mode. As can be seen, every combination of maximum speed and minimum speed in the matrix of Table 7 results in an efficiency higher than 262 CFM/W, namely the efficiency in the first mode.

When considering the additional factors in selecting the second maximum speed and the second minimum speed, the first additional factor is that the resulting efficiency in the second mode must be greater than a given threshold value, such as the highest reported efficiency of any fan in the same class as the first fan model. In this instance, the highest reported efficiency of any fan in the same class as the first fan model (i.e., the Energy Star 52 inch or less class) is 345 CFM/W (though this value may change with improved efficiency of newer ceiling fan models over time). Accordingly, selecting any combination of second maximum speed and second minimum speed from Table 7 that is above 345 CFM/W would result in the first fan model having the highest ceiling fan efficiency of any fan in its class when operating in the second mode. These combinations of second maximum speed and second minimum speed are italicized in Table 7.

This still leaves a wide range of combinations of maximum and minimum speeds available for use in the second mode. Accordingly, the other additional factors may be considered in selecting a final second maximum speed and a second minimum speed. The second additional factor is the user functionality, namely the range of speeds operable within the second mode. As can be seen from Table 7, the highest estimated ceiling fan efficiency of 381.5 CFM/W occurs with a maximum speed of 110 RMP and a minimum speed of 100 RPM. However, this is a very narrow range of speeds, spanning only 10 RPM. For comparison purposes, an estimated ceiling fan efficiency of 348.3 CFM/W may be achieved at a maximum speed of 150 RPM and a minimum speed of 75 RPM (for a range of speeds spanning 75 RPMs). Therefore, widening the range of speeds of the second mode tends to lower the ceiling fan efficiency in the second mode, and the relative importance of each factor must be weighed in selecting the second maximum speed and the second minimum speed.

The third additional factor to consider in selecting the second maximum speed and the second minimum speed of the second mode is the classification of the fan in operation. According to DOE standards, the maximum speed at which a 52-inch fan with a thickness of edges of blades greater than or equal to 3.2 mm, but less than 4.8 mm (as is the case with the first fan model) may operate is 176 RPM in order to be classified as a low-speed small-diameter fan. Because all maximum speeds that would result in a ceiling fan efficiency above 345 CFM/W are less than 176 RPM, this factor would not affect the selection of a second maximum speed.

By weighing the above factors to allow for a ceiling fan efficiency in the second mode of above 345 CFM/W, and allowing for a relatively wide range of speeds, while still providing a relatively high ceiling fan efficiency, a combination of a second maximum speed of approximately 140 RPM and a second minimum speed of approximately 80 RPM may be selected to result in an estimated efficiency of 360.6 CFM/W in the second mode. Furthermore, these values for the second maximum speed and the second minimum speed are quite close to certain preset speeds of the first fan model in the first mode, as outlined in Table 3 (i.e., preset speed 4 and preset speed 2). Accordingly, the second mode may be relatively easily selected by simply limiting the second maximum speed to preset speed 4 and the second minimum speed to preset speed 2.

By utilizing the first and second mathematical relationships estimated for the first fan model, using the preset speeds 2 and 4 to operate the fan in the second mode, namely with a second maximum speed of 140 RPM and a second minimum speed of 79 RPM, a calculated ceiling fan efficiency of 360 CFM/W may be achieved in the second mode. This efficiency, along with average airflow during operation, average power, and average energy cost in the second mode, calculated according to DOE standards, are provided in Table 8. As can be seen, the efficiency is raised, and the average power and annual energy cost are decreased in the second mode, as compared to the first mode of Table 5.

TABLE 8

DOE Efficiency - Second Mode of First Fan Model

| | | |
|---|---|---|
| Efficiency | 360 | CFM/W |
| Average Airflow | 3467 | CFM |
| Average Power | 10 | W |
| Annual Energy Cost | $3 | |

Example 2:

In a second example, a second fan model is a 52-inch diameter fan adapted for rotating at a plurality of preset speeds across a first speed range in the first mode. In this instance, the plurality of preset speeds comprises 7 preset speeds. Steady-state speed (RPM), power consumption (W), and air flow rate (CFM) may be measured across the first speed range, as indicated in Table 9. A measure of the steady state air flow rate per watt may also be calculated at each of the preset speeds.

TABLE 9

Performance Data of First Mode of Second Fan Model

| Speed | RPM | Power | CFM | CFM/W |
|---|---|---|---|---|
| 1 | 60.2 | 2.9 | 1509 | 520 |
| 2 | 80.2 | 3.8 | 2038 | 536 |
| 3 | 100.1 | 5.3 | 2612 | 493 |
| 4 | 120.7 | 7.3 | 3130 | 429 |
| 5 | 140.5 | 10.1 | 3645 | 361 |
| 6 | 161.6 | 13.8 | 4164 | 302 |
| 7 | 180.1 | 18.7 | 4703 | 251 |

Much as with Example 1, the performance data of Table 9 (along with a known standby power consumption of 1.3 W) can be used to calculate the ceiling fan efficiency, average airflow during operation, average power, and average energy cost of the second fan model, when operated in the first mode, as indicated in Table 10.

TABLE 10

DOE Efficiency - First Mode of Second Fan Model

| | | |
|---|---|---|
| Efficiency | 216 | CFM/W |
| Average Airflow | 3206 | CFM |
| Average Power | 15 | W |
| Annual Energy Cost | $4 | |

As with Example 1, the first mathematical relationship and the second mathematical relationship may be estimated for the second model fan. Again, the first mathematical relationship between the fan speed and the volumetric air flow rate of the second fan model may be linear, and may be characterized as follows:

$$VAFR_2=(26.407\times FS_2)-67.24$$

Where:

$VAFR_2$=volumetric air flow rate of the second fan model (CFM), and $FS_2$=fan speed of the second fan model (RPM).

Similarly, the second mathematical relationship between the fan speed and the power consumption of the second fan model may be non-linear and may be represented by a polynomial equation as follows:

$$PC_2=4.777\times10^{-6}\times FS_2^3-7.39\times10^{-4}\times FS_2^2+8.512\times10^{-2}\times FS_2-0.634$$

Where:

$PC_2$=power consumption of the second fan model (W), and $FS_2$=fan speed of the second fan model (RPM).

Similar to Example 1, various performance characteristics at different maximum speeds and minimum speeds may be calculated, thereby resulting in a matrix of estimated ceiling fan efficiency ratings based on various combinations of maximum speeds and minimum speeds, as outlined in Table 11.

TABLE 11

Estimated Efficiency Ratings of Second Fan Model at Various Combinations of Second Maximum Speed and Second Minimum Speed

| Low RPM | High RPM 100 | 110 | 120 | 130 | 140 | 150 | 160 | 170 | 180 | 190 |
|---|---|---|---|---|---|---|---|---|---|---|
| 50 | 261.2 | 263.4 | 262.7 | 259.1 | 252.9 | 244.5 | 234.4 | 223.2 | 211.2 | 198.9 |
| 55 | 265.5 | 267.5 | 266.5 | 262.7 | 256.2 | 247.7 | 237.4 | 226.0 | 213.8 | 201.4 |
| 60 | 269.7 | 271.4 | 270.2 | 266.1 | 259.5 | 250.8 | 240.3 | 228.7 | 216.4 | 203.8 |
| 65 | 273.7 | 275.2 | 273.7 | 269.4 | 262.6 | 253.7 | 243.1 | 231.4 | 218.9 | 206.1 |
| 70 | 277.4 | 278.6 | 277.0 | 272.6 | 265.6 | 256.5 | 245.8 | 233.9 | 221.3 | 208.4 |
| 75 | 280.8 | 281.8 | 280.0 | 275.4 | 268.3 | 259.1 | 248.3 | 236.3 | 223.5 | 210.5 |
| 80 | 283.8 | 284.6 | 282.7 | 278.0 | 270.8 | 261.5 | 250.6 | 238.5 | 225.7 | 212.5 |
| 85 | 286.3 | 287.1 | 285.0 | 280.2 | 272.9 | 263.6 | 252.6 | 240.5 | 227.6 | 214.4 |
| 90 | 288.5 | 289.1 | 286.9 | 282.0 | 274.8 | 265.4 | 254.4 | 242.2 | 229.3 | 216.0 |
| 95 | 290.1 | 290.6 | 288.3 | 283.5 | 276.2 | 266.9 | 255.9 | 243.7 | 230.8 | 217.5 |
| 100 | 291.1 | 291.6 | 289.3 | 284.5 | 277.3 | 268.0 | 257.1 | 245.0 | 232.1 | 218.8 |
| | Maximum DOE Eff | | | 291.6 | | | | | | |

When selecting the second maximum speed and the second minimum speed for the second mode of the second fan model, the first consideration is again that the resulting efficiency is greater than the efficiency in the first mode of the second fan model. Every combination of maximum speed and minimum speed in the matrix of Table 11 that is within the range of maximum speed and minimum speeds of Table 9 results in an efficiency higher than 216 CFM/W, namely the efficiency in the first mode.

When considering the first additional factor, namely that the resulting efficiency in the second mode must be greater than a given threshold value, such as the highest reported efficiency of any fan in the same class as the first fan model, this factor is not achievable in the context of the second fan model. Specifically, the second fan is in the same class as the first fan, namely the Energy Star 52 inch or less class. Accordingly, the highest ceiling fan efficiency in this class remains 345 CFM/W. But as can be seen from Table 11, the second fan model cannot achieve a ceiling fan efficiently matching or exceeding 345 CFM/W. Therefore, this first additional factor does not affect the selection of the second maximum speed and the second minimum speed of the second mode.

As for the third additional factor, namely the selection of the second maximum speed and/or the second minimum speed such that the fan when operating in the second mode may fall within a certain classification, the similar size of the size of the second fan model to the first fan model indicates that the second maximum speed should again not exceed 176 RPM in order to be classified as a low-speed small-diameter fan.

Turning to the second factor, namely the functionality which allows for a wide range of speeds within which the fan may operate in the second mode, by process of elimination, this will be the main factor in determining the second maximum speed and the second minimum speed. Because the first and third factors are not constraining in this instance, there is some degree of freedom to balance the need to provide a relatively wide range of speeds in the second mode with the desire to increase efficiency, at least as compared to the first mode. If a high range of speeds is desired, then the efficiency must be compromised somewhat. If a high efficiency is desired, then the range of speeds must be compromised somewhat.

Furthermore, the matrix of calculated efficiencies is not limiting with respect to specific speeds that may be chosen for the second maximum speed and the second minimum speed. These calculated values may function as a guide for visualizing estimated efficiencies, such as efficiencies at odd speeds or other speeds between those corresponding to calculated values. For example, a second maximum speed of 140 RPM and a second minimum speed of 80 RPM results in a calculated efficiency of 270.8 CFM/W, while providing a second range of speeds spanning 60 RPM. That may be compared to a second maximum speed of 150 RPM and a second minimum speed of 80 RPM resulting in a calculated efficiency of 261.5 CFM/W, while providing a second range of speeds of 70 RPM. If desired, these calculated values may be used to select one or more intermediate values for speed, such as a second maximum speed of 145 RPM and a second minimum speed of 80 RPM. This results in a calculated efficiency of 267 CFM/W, while providing a second range of speeds spanning 65 RPM. By utilizing this second maximum speed of 145 RPM and second minimum speed of 80 RPM, the ceiling fan efficiency, the average airflow during operation, the average power, and the average energy cost in the second mode may be achieved, as outlined in Table 12.

TABLE 12

| DOE Efficiency - Second Mode of Second Fan Model | | |
|---|---|---|
| Efficiency | 267 | CFM/W |
| Average Airflow | 2957 | CFM |
| Average Power | 11 | W |
| Annual Energy Cost | $3 | |

Example 3:

In a third example, a third fan model is an 84-inch diameter fan adapted for rotating at a plurality of preset speeds across a first speed range in the first mode. In this instance, the plurality of preset speeds comprises 7 preset speeds. As above, steady-state speed (RPM), power consumption (W), and air flow rate (CFM) may be measured across the first speed range, as indicated in Table 13. A measure of the steady state air flow rate per watt may also be calculated at each of the preset speeds.

TABLE 13

| Performance Data of First Mode of Third Fan Model | | | | |
|---|---|---|---|---|
| Speed | RPM | Power | CFM | CFM/W |
| 1 | 45 | 4 | 5052 | 1263 |
| 2 | 64.8 | 7.2 | 7613 | 1057 |
| 3 | 83 | 12.4 | 9836 | 793 |
| 4 | 99 | 19.9 | 11693 | 588 |
| 5 | 113.5 | 28.4 | 13481 | 475 |
| 6 | 125.4 | 40.3 | 14926 | 370 |
| 7 | 136.7 | 52.6 | 16389 | 312 |

And as with the previous examples, the performance data of Table 13 (along with a known standby power consumption of 1.5 W) can be used to calculate the ceiling fan efficiency, average airflow during operation, average power, and average energy cost of the third fan model, when operated in the first mode, as indicated in Table 14.

TABLE 14

| DOE Efficiency - First Mode of Third Fan Model | | |
|---|---|---|
| Efficiency 326 | 326 | CFM/W |
| Average Airflow | 11075 | CFM |
| Average Power | 34 | W |
| Annual Energy Cost | $10 | |

The first mathematical relationship and the second mathematical relationship may also be estimated for the third fan model, as with the previous examples. Again, the first mathematical relationship between the fan speed and the volumetric air flow rate of the third fan model may be linear, and may be characterized as follows:

$$VAFR_3=(122.514\times FS_3)-396.55$$

Where:

$VAFR_3$=volumetric air flow rate of the third fan model (CFM), and $FS_3$=fan speed of the third fan model (RPM).

Similarly, the second mathematical relationship between the fan speed and the power consumption of the third fan model may be non-linear and may be represented by a polynomial equation as follows:

$$PC_3=4.226\times10^{-5}\times FS_3^3-5.397\times10^{-3}\times FS_3^2+0.377\times FS_3-5.927$$

Where:

$PC_3$=power consumption of the third fan model (W), and $FS_3$=fan speed of the third fan model (RPM).

Furthermore, various performance characteristics at different maximum speeds and minimum speeds may be calculated, as in the previous examples, thereby resulting in a matrix of estimated ceiling fan efficiency ratings based on various combinations of maximum speeds and minimum speeds, as outlined in Table 15.

TABLE 15

| Estimated Efficiency Ratings of Third Fan Model at Various Combinations of Second Maximum Speed and Second Minimum Speed | | | | | | | | | | |
|---|---|---|---|---|---|---|---|---|---|---|
| Low RPM | High RPM 100 | 110 | 120 | 130 | 140 | 150 | 160 | 170 | 180 | 190 |
| 50 | 528.7 | 472.1 | 416.0 | 363.4 | 316.3 | 275.1 | 239.6 | 209.4 | 183.6 | 161.8 |
| 55 | 533.8 | 477.4 | 421.2 | 368.4 | 320.9 | 279.2 | 243.3 | 212.6 | 186.5 | 164.3 |
| 60 | 537.6 | 481.7 | 425.6 | 372.8 | 325.0 | 283.0 | 246.7 | 215.6 | 189.1 | 166.6 |
| 65 | 539.6 | 484.6 | 429.1 | 376.4 | 328.6 | 286.4 | 249.8 | 218.5 | 191.7 | 168.9 |
| 70 | 539.7 | 486.0 | 431.3 | 379.2 | 331.5 | 289.3 | 252.6 | 221.0 | 194.0 | 171.0 |
| 75 | 537.5 | 485.6 | 432.2 | 380.9 | 333.7 | 291.7 | 255.0 | 223.3 | 196.1 | 172.9 |
| 80 | 532.8 | 483.1 | 431.5 | 381.4 | 335.0 | 293.4 | 256.8 | 225.2 | 198.0 | 174.7 |
| 85 | 525.7 | 478.7 | 429.2 | 380.6 | 335.3 | 294.3 | 258.2 | 226.7 | 199.5 | 176.2 |
| 90 | 516.1 | 472.1 | 425.2 | 378.6 | 334.6 | 294.5 | 258.9 | 227.7 | 200.7 | 177.4 |
| 95 | 504.1 | 463.6 | 419.5 | 375.1 | 332.8 | 293.9 | 259.0 | 228.3 | 201.6 | 178.4 |
| 100 | 490.1 | 453.1 | 412.1 | 370.3 | 329.9 | 292.3 | 258.4 | 228.4 | 202.0 | 179.1 |
| | Maximum DOE Eff | | | 539.7 | | | | | | |

When selecting the second maximum speed and the second minimum speed for the second mode of the third fan model, the first consideration remains that the resulting efficiency is greater than the efficiency in the first mode of the third fan model. Every combination of maximum speed and minimum speed in the matrix of Table 15 that is within the range of maximum speed and minimum speeds of Table 13 results in an efficiency higher than 326 CFM/W, namely the efficiency in the first mode.

When considering the first additional factor, namely that the resulting efficiency in the second mode must be greater than a given threshold value, such as the highest reported efficiency of any fan in the same class as the first fan model, it is noted that the highest reported efficiency of any fan in the same class as the third fan model (i.e., the Energy Star 61 inch or larger class) is 431 CFM/W. Accordingly, selecting any combination of second maximum speed and second minimum speed from Table 15 that is above 431 CFM/W would result in the third fan model having the highest ceiling fan efficiency of any fan in its class when operating in the second mode. These combinations of second maximum speed and second minimum speed are italicized in Table 15.

As noted above, the third additional factor is the selection of the second maximum speed and/or the second minimum speed such that the fan when operating in the second mode may fall within a certain classification. According to DOE standards, the maximum speed at which an 84-inch fan with a thickness of edges of blades greater than or equal to 3.2 mm, but less than 4.8 mm (as is the case with the third fan model) may operate is 109 RPM in order to be classified as a low-speed small-diameter fan. Accordingly, if the third fan is to be considered a low-speed small-diameter fan when operating in the second mode, then the second maximum speed cannot exceed 109 RPM. Therefore, in order to account for both the above-noted limitations of the first additional factor and the third additional factor, the eventual resulting efficiency should fall somewhere between the first and second columns in Table 15, corresponding to some combination of second maximum speed and second minimum speed in this range.

Turning to the second factor, namely the functionality which allows for a wide range of speeds within which the fan may operate in the second mode, there is some degree of freedom in selecting a given second maximum speed and a second minimum speed. As before, this selection of a relatively wide range of second speeds must be balanced against the competing and inversely related efficiency rating. Accordingly, if a larger range of speeds is desired, then the efficiency must be compromised somewhat. And if a higher efficiency is desired, then the span of the range of speeds must be compromised somewhat.

As noted in regard to the second example, the matrix of calculated efficiencies is not limiting with respect to specific speeds that may be chosen for the second maximum speed and the second minimum speed, but rather illustrate various estimated efficiencies at various combinations of maximum speeds and minimum speeds. In this example, given the constraint of the maximum speed based on the second factor, and the desire to provide a relatively wide range of speeds from a functionality standpoint, it may be advantageous to select a maximum speed that is quite close to the highest allowed maximum speed for the class. Since the maximum speed cannot exceed 109 RMP in order to remain in the low-speed small-diameter fan class, a second maximum speed of 108 RPM may be selected.

When selecting a second minimum speed, the matrix of Table 15 may be instructive. For example, 108 RPM is quite close to 110 RPM, so the second column of Table 15 may provide a close approximation of what efficiencies may be achieved at various corresponding second minimum speeds. As can be see, the efficiency of the second column appears to peak at a second minimum speed of approximately 65-70 RPM. When considering the second factor, a second minimum speed of 65 RPM provides a slightly wider range of second speeds. Accordingly, in consideration of the second additional factor, the second minimum speed may be selected as 65 RPM.

Once a second maximum speed of 108 RPM and a second minimum speed of 65 RPM have been selected, a ceiling fan efficiency may be calculated according to DOE regulations as noted above, resulting in an efficiency of 496 CFM/W, while providing a second range of speeds spanning 43 RPM. By utilizing this second maximum speed of 108 RPM and second minimum speed of 65 RPM, the ceiling fan efficiency, the average airflow during operation, the average power, and the average energy cost in the second mode may be achieved, as outlined in Table 16.

TABLE 16

| DOE Efficiency - Second Mode of Third Fan Model | | |
|---|---|---|
| Efficiency | 496 | CFM/W |
| Average Airflow | 10,366 | CFM |
| Average Power | 21 | W |
| Annual Energy Cost | $6 | |

Once the second maximum speed and the second minimum speed have been selected, such as according to the methods described with respect to Examples 1-3, the controller 20 may be programmed to operate the fan 10 in the second mode when the user selects the second mode. The second maximum speed and the second minimum speed associated with the second mode may be pre-programmed into software or firmware of the fan, such as in association with the controller 20.

The software or firmware of the controller may be adapted to be updated, should any of the considerations or criteria for selection of the second maximum speed and the second minimum speed change. For example, if a fan in the same class as the fan 10 subsequently reports a higher efficiency than an original highest efficiency used to select the second maximum speed and the second minimum speed for the fan 10, then the software or firmware may be updated to reflect this higher efficiency. Accordingly, a new second maximum speed and second minimum speed may be selected to account for this new highest efficiency of another fan in the same classification.

Similarly, if any standards change such that a maximum speed for a given classification change, then the software or firmware may be updated to reflect this new maximum speed, and may update the selected second maximum speed and second minimum speed accordingly.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Each of the following terms written in singular grammatical form: “a”, “an”, and “the”, as used herein, means “at least one”, or “one or more”. Use of the phrase “one or more” herein does not alter this intended meaning of “a”, “an”, or “the”. Accordingly, the terms “a”, “an”, and “the”, as used herein, may also refer to, and encompass, a plurality of the stated entity or object, unless otherwise specifically defined or stated herein, or the context clearly dictates otherwise. For example, the phrases: “a unit”, “a device”, “an assembly”, “a mechanism”, “a component,” “an element", and "a step or procedure", as used herein, may also refer to, and encompass, a plurality of units, a plurality of devices, a plurality of assemblies, a plurality of mechanisms, a plurality of components, a plurality of elements, and a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase "consisting essentially of." Each of the phrases "consisting of" and "consists of, as used herein, means "including and limited to". The phrase "consisting essentially of means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, generally, etc., as used herein, refer to ±10% of the stated numerical value or as close as possible to a stated condition.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

Having shown and described various embodiments, further adaptations of the inventive aspects described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not necessarily required. Accordingly, the scope of the present invention should be considered in terms of the claims and is understood not to be limited to the details of structure and operation shown and described in the specification and drawings.

The invention claimed is:

1. An apparatus, comprising:

a fan; and a controller configured for controlling the fan to operate in a first mode, said first mode limiting rotational speed of the fan within a first range of speeds between a first minimum speed and a first maximum speed, and further configured for controlling the fan to operate in a second mode, said second mode limiting rotational speed of the fan within a second range of speeds between a second minimum speed and a second maximum speed;

wherein the second range of speeds is narrower than the first range of speeds;

wherein the fan operates at a first efficiency in the first mode, and wherein the fan operates at a second efficiency in the second mode, and wherein the second efficiency is greater than the first efficiency; and wherein the controller is adapted to calculate the second efficiency based at least partially on an extrapolation of volumetric flow rate and an extrapolation of power consumption of the fan at the second minimum speed and the second maximum speed.

2. The apparatus of claim 1, wherein the first range of speeds includes at least one preset speed between the first minimum speed and the first maximum speed.

3. The apparatus of claim 1, wherein the first range of speeds includes a plurality of preset speeds between the first minimum speed and the first maximum speed.

4. The apparatus of claim 1, wherein the second range of speeds includes at least one preset speed between the second minimum speed and the second maximum speed.

5. The apparatus of claim 1, wherein the second range of speeds includes a plurality of preset speeds between the second minimum speed and the second maximum speed.

6. The apparatus of claim 1, wherein the controller is adapted to calculate the first efficiency and the second efficiency as a ratio of total airflow induced by the fan over a given time period to total power consumption by the fan over the given time period.

7. The apparatus of claim 1, wherein the extrapolation of volumetric flow rate is based on a regression of volumetric flow rate versus speed of the fan in the first mode.

8. The apparatus of claim 1, wherein the extrapolation of power consumption is based on a regression of power consumption versus speed of the fan in the first mode.

9. A method of operating a fan comprising:

operating the fan in a first mode, said first mode limited to a first range of speeds between a first minimum speed and a first maximum speed;

operating the fan in a second mode, said second mode limited to a second range of speeds between a second minimum speed and a second maximum speed, wherein the second range of speeds is narrower than the first range of speeds:

calculating a first efficiency of the fan in the first mode, wherein calculating the first efficiency comprises dividing a total air flow of the fan in the first mode over a first time period by a total power consumption of the fan in the first mode over the first time period: and extrapolating a first mathematical relationship between fan speed and volumetric air flow rate of the fan in the first mode.

10. The method of claim 9, further comprising measuring fan speed, volumetric air flow rate, and power consumption of the fan in the first mode.

11. The method of claim 9, further comprising the step of extrapolating a second mathematical relationship between fan speed and power consumption of the fan in the first mode.

12. The method of claim 9, further comprising the steps of:

estimating a minimum volumetric air flow rate at the second minimum speed and a maximum volumetric air flow rate at the second maximum speed of the fan in the second mode based on the first mathematical relationship; and estimating a minimum power consumption at the second minimum speed and a maximum volumetric air flow rate at the second maximum speed of the fan in the second mode based on the second mathematical relationship.

13. The method of claim 12, further comprising the step of calculating a second efficiency of the fan in the second mode by dividing a total air flow of the fan in the second mode at the second minimal speed and the second maximum speed over a second time period by a total power consumption of the fan in the second mode at the second minimum speed and the second maximum speed over the second time period approximately equal to the first time period.

14. The method of claim 13, further comprising the step of selecting the second minimum speed and the second maximum speed such that the second efficiency is higher than the first efficiency.

15. The method of claim 13, further comprising the step of selecting the second minimum speed and the second maximum speed such that the second efficiency is higher than a threshold value.

* * * * *